United States Patent [19]

Dehm

[11] 4,400,281

[45] Aug. 23, 1983

[54] YARN PROCESSING LUBRICANTS

[75] Inventor: David C. Dehm, Thornton, Pa.

[73] Assignee: Atlantic Richfield Co., Los Angeles, Calif.

[21] Appl. No.: 294,110

[22] Filed: Aug. 19, 1981

[51] Int. Cl.[3] ..... D06M 15/26; D06M 13/02; D06M 13/20

[52] U.S. Cl. ..... 252/8.6; 252/49.3; 252/56 R

[58] Field of Search ..... 252/8.6

[56] References Cited

U.S. PATENT DOCUMENTS

| | | | |
|---|---|---|---|
| 3,692,676 | 9/1972 | Culter et al. | 526/159 |
| 3,959,534 | 5/1976 | Park et al. | 252/8.6 |
| 3,977,979 | 8/1976 | Crossfield et al. | 260/29.6 ME |
| 4,031,158 | 6/1977 | Isa et al. | 585/532 |
| 4,098,702 | 7/1978 | Crossfield et al. | 8/115.6 |
| 4,098,703 | 7/1978 | Crossfield et al. | 252/8.9 |
| 4,105,569 | 8/1978 | Crossfield | 428/391 |

FOREIGN PATENT DOCUMENTS

| | | | |
|---|---|---|---|
| 2550173 | 5/1976 | Fed. Rep. of Germany | 252/8.6 |

*Primary Examiner*—Maria Parrish Tungol

*Attorney, Agent, or Firm*—C. R. Reap; D. M. Kozak; J. C. Martin, Jr.

[57] ABSTRACT

Disclosed are textile lubricants having improved adherency to textile fibers, comprised of a lubricant base oil, an emulsifier and a high molecular weight polymer of one or more alpha-monoolefins having 4 to 20 carbon atoms.

16 Claims, No Drawings

YARN PROCESSING LUBRICANTS

BACKGROUND OF THE INVENTION

This invention relates to textile lubricants and more particularly to improved low sling textile lubricants.

DESCRIPTION OF THE PRIOR ART

In the manufacture of textile yarns it is economically important to process the yarn fibers at high speeds. A number of problems arise because of high speed operations; for example, the yarn fibers are subject to breakage due to tension developed in yarn stretching and winding operations and the yarn fibers undergo excess wear and fraying as a result of friction caused by the high speed movement of the yarn fibers over metal and ceramic machinery guides. To overcome these problems, it is customary to apply a lubricant to the yarn fibers. Lubricants overcome the above-mentioned and they also provide additional benefits, for example, they effect even winding of fiber yarns onto cones and subsequent smooth release of the yarn from the cones during knitting, weaving and tufting operations.

On the other hand, the use of lubricants in yarn processing creates problems not previously encountered. One such problem is slinging, i.e. the throwing of lubricant from the yarn as it moves at high speeds. Oil slung from yarns accumulates on the floor of the work space, thereby creating an untidy and dangerous condition. Furthermore, oil sling often results in the formation of a mist in the area, resulting in a breathing hazard.

Various additives have been incorporated into textile lubricant formulations in attempts to eliminate or reduce slinging and dripping of the lubricant. These additives are usually designed to increase the adhesive and cohesive strengths of the lubricants without reducing their lubricity. U.S. Pat. Nos. 3,977,979; 4,098,702; 4,098,703 and 4,105,569 disclose the use of ethylene-propylene copolymer, isobutylene homopolymer or copolymer and other polymers as viscosity index improvers for yarn finishing formulations. U.S. Pat. No. 4,031,158 states that the polyolefin oils disclosed therein can be used as textile finishing agents. The disclosures of these patents is incorporated herein by reference.

SUMMARY OF THE INVENTION

It has now been discovered that the adherency of textile lubricant can be improved markedly without reducing the lubricity of the lubricant by incorporating into the lubricant a high molecular weight polymer of one or more normal-alphamonoolefins having 4 to 20 carbon atoms. The polymer is generally added at an amount effective to reduce the slinging tendency of the lubricant, which is usually in the range of about 0.01 to 10 percent, based on the total weight of lubricant. Suitable polymers have a weight average molecular weight of about 100,000 to 20 million and preferably about 1 million to 10 million. In other preferred embodiments of the invention the normal alpha-monoolefin polymer is incorporated into the lubricant formulation at a concentration in the range of about 0.05 to 5 parts per 100 parts by weight of lubricant and the polymer is an amorphous polymer of at least one normal alpha-monoolefin having 4 to 14 carbon atoms. Particularly preferred homopolymers are those prepared from normal alpha-monoolefins having 4 to 14 carbon atoms and copolymers of butene-1 and another alpha-monoolefin having 5 to 14 carbon atoms.

DETAILED DESCRIPTION OF THE INVENTION

Textile lubricants are usually comprised of a lubricant base, which serves as a carrier vehicle for the lubricant formulation, and several special purpose additives. The most widely used lubricant bases are hydrocarbon oils, such as mineral oil, fatty acid esters and natural fats and oils. Mineral oil based-lubricants are generally used for processing synthetic yarns, particularly at high speeds, while fatty esters and natural oil based lubricants are primarily used for processing natural fibers.

The sling-reducing additives disclosed herein can be used either in mineral oil-based textile lubricants or in lubricants based on fatty acid esters or natural oils, but the major application is in mineral oil-based lubricants for synthetic yarn processing and, accordingly, the description of the invention will be principally directed to mineral oil-based lubricants.

In most synthetic yarn processing lubricants the mineral oil constitutes about 50 to 95% of the total weight of the lubricant formulation and in high speed yarn processing lubricants the mineral oil constitutes about 85 to 95% by weight of the lubricant formulation. Mineral oils used in synthetic yarn processing lubricants generally have viscosities in the range of about 5 to 120 SUS (Saybolt universal seconds), measured at 100° F., and often these mineral oils have a viscosity in the range of about 60 to 100 SUS at 100° F.

White oils, which are more refined mineral oils are usually preferred because they are colorless and odorless and have superior stability.

The lubricant must be easily and completely removable so that it will not interfere with dyeing and other finish treatment operations. The lubricant is usually removed by scouring the yarn with water. To facilitate removal an emulsifier is generally incorporated into the lubricant formulation at concentrations of about 2 to 50% based on the total weight of the lubricant formulation. It has been generally found that a concentration of about 5 to 15% based on the total weight of lubricant formulation produces satisfactory results for most yarn processing operations.

The emulsifier may be any oil soluble anionic or nonionic surfactant. The oil soluble emulsifier may be a mixture of one or more surfactants which form a compatible formulation with the mineral oil. Useful anionic surfactants include saturated and unsaturated fatty acids. Useful nonionic emulsifiers include ethoxylated alcohols, ethoxylated saturated or unsaturated fatty acids, ethoxylated alkyl phenols and the like. Oil soluble polyethylene glycol ethers obtained by the reaction of $C_{11-15}$ linear secondary alcohols with from about 3 to 9 moles of ethylene oxide may be used as well as oil soluble mixtures obtained by blending these ethers may be used. Likewise, oil soluble polyethylene glycol ethers of OXO alcohols having the same number of carbon atoms and ethylene oxide contents as the linear secondary alcohols and oil soluble mixtures of ethers of these OXO alcohols may be used. It may be necessary to use mixtures of emulsifiers to obtain compatible formulations with the mineral oil. If necessary, a coupling agent such as water, butyl alcohol or the monobutylether of ethylene glycol may be used. The art of blending emulsifiers and using coupling agents to obtain compatible formulations with mineral oils is well known in the art.

The polymeric additives which have been found to be effective to significantly reduce or eliminate lubricant sling according to this invention are the polymers prepared from one or more normal alpha-monoolefins having 4 to 20 carbon atoms. The additives may be homopolymers, such as polybutene-1, polyhexene-1, polydecene-1 or polydodecene-1, or they may be copolymers of two or more normal alpha-monoolefins having 4 to 20 carbon atoms, such as butene-1-dodecene-1 copolymer, hexene-1-decene-1 copolymer, etc. Preferred homopolymers are those having 6 to 14 carbon atoms, particularly polyhexene-1, polyoctene-1, polydecene-1, polydodecene-1 and polytetradecene-1. Preferred copolymers are prepared from butene-1 and at least one other alpha-monoolefin having 6 to 14 carbons, particularly butene-1-hexene-1 copolymer, butene-1-octene-1 copolymer, butene-1-decene-1 copolymer, butene-1-dodecene-1 copolymer and butene-1-tetradecene-1 copolymer. The polymer additives of this invention preferably have high molecular weights. Suitable polymers usually have weight average molecular weights of about 100,000 or higher and preferably about 100,000 to 20 million. The most preferred weight average molecular weight range of polymer additives useful in this invention is about 1 million to 10 million.

The method of polymerization of the monomers is not a part of the invention. In general, any of the several well known methods for polymerizing alpha-monoolefins can be employed. A particularly suitable method is the Ziegler process using catalyst systems comprising combinations of a compound of a metal of Groups IV-B, V-B, VI-B or VIII of the Periodic Chart of the Elements found on pages 392–393 of the Handbook of Chemistry and Physics, 37th Edition with an organometal compound of a rare earth or metal from Groups I-A, II-A or III-A of the Periodic Chart of the Elements. Particularly suitable catalyst systems are those comprising titanium halides and organoaluminum compounds. A typical polymerization procedure is to contact the monomeric mixture with the catalyst in a suitable inert hydrocarbon solvent for the monomers and the catalyst in a closed reaction vessel at reduced temperatures and autogenous pressure and in a nitrogen atmosphere. Further details of the Ziegler process are set forth in U.S. Pat. No. 3,692,676, which is incorporated herein by reference.

U.S. Pat. No. 3,692,676 and U.S. application Ser. No. 230,775, filed Feb. 2, 1981, incorporated herein by reference describes homopolymer and copolymers which are suitable for use in this invention.

The polymer additive is present in the lubricant at a concentration which is effective to reduce or eliminate the tendency of the non-polymer-containing lubricant to sling off the yarn during processing. In general concentrations of about 0.01 to 10%, based on the total weight of lubricant formulation will be effective to produce the desired result. The preferred concentration is about 0.05 to 5% and the most preferred concentration is about 0.1 to 2%, based on the total weight of lubricant formulation.

The polymer additive can be added to the lubricant base as a solid and subsequently dissolved in the base or it can be dissolved in a solvent, such as a light petroleum distillate, e.g. kerosene or naphtha, and the solution blended with the lubricant base. Further details relating to the addition of such polymers to the lubricant base are set forth in earlier-mentioned U.S. Pat. No. 3,977,979.

Other additives can be included in the lubricant formulation to provide specific benefits. For example, antistatic agents, antioxidants, corrosion inhibitors, fiber softeners, bactericides, wetting agents, etc. can be added to the formulation, as desired.

The lubricant is applied to the yarn by any conventional technique. One suitable technique for applying lubricant to yarn is by the use of a kiss roll. A kiss roll consists of a roller which rotates about a horizontal axis and which is partly submerged in a trough containing lubricant. The yarn strands contact the surface of the rotating roller, thereby picking up lubricant. The amount of lubricant picked up by the yarn can be varied by changing the roll speed, roll direction, angle of contact of the roll with the yarn and the viscosity of the lubricant. A detailed description of the use of a kiss roll for applying textile lubricant to yarn is presented in Modern Knitting Management, vol. 7, 1981, pp. 38–40, which is incorporated herein by reference.

The amount of lubricant applied to the yarn will depend upon the particular application. For example, coning oils, which are oils used to facilitate uniform winding of yarns on cones and subsequent removal therefrom, are generally applied at higher concentrations than are throwing oils, which are texturizing oils for filament yarns. In general, the amount of textile lubricants applied to yarn varies between about 0.1 to 10% and it is usually in the range of about 0.5 to 6%, based on the weight of the yarn.

The following examples illustrate specific embodiments of the invention. Unless otherwise indicated parts and percentages are on a weight basis.

EXAMPLES

EXAMPLE I

A textile lubricant is prepared by combining 90 parts of white mineral oil having a viscosity of 54.3 at 100° F. (sold by Atlantic Richfield Company under the trademark "Tufflo 6004") and 10 parts of ethoxylated $C_{12}$–$C_{13}$ alcohol emulsifier (sold by Shell Chemical Company under the trademark "Neodol 23-3"). The mixture is blended until it is uniform.

The following technique is used to apply the above textile lubricant to the yarn and to determine the degree of lubricant sling which results from the use of the above lubricant. The trough of a kiss roll yarn lubricant applicator is filled with the above lubricant and nylon yarn is contacted with the roll of the applicator as the yarn is wound on standard high speed yarn winding equipment. The kiss-roll speed is adjusted so that about 3%, based on the weight of yarn, of lubricant is applied to the yarn as it passes over the kiss-roll. The yarn is wound at normal commercial operating speed (about 1100 meters per minute).

A considerable degree of misting and lubricant throw-off will be observed in areas where the direction of the moving yarn is suddenly changed. However the friction between the yarn and the machine guides of the test equipment is much less than that observed when yarn which contains no lubricant coating is tested in the same manner.

EXAMPLE II

A textile lubricant is prepared as in EXAMPLE I except that the formulation contains 89 parts of Tufflo 6004 brand mineral oil and 1 part of antisling additive (a butene-1 dodecene-1 copolymer containing 35% mole $C_4$ units and having a weight average molecular weight of about 4 million (sold by ARCO Chemical Company, Division of Atlantic Richfield Company as a 10 weight percent mixture in petroleum distillate under the trademark "ARCOFLO Booster").

When synthetic yarn is coated with 3% of the above lubricant and tested in accordance with the procedure of EXAMPLE I very little or no lubricant throw-off or misting will be observed and the friction observed in this test will be no greater than that observed in the test in EXAMPLE I.

EXAMPLE III

A textile lubricant is prepared in accordance with the procedure of EXAMPLE II except that polydecene-1 having a weight average molecular weight of about 1 million is substituted for the ARCOFLO Booster brand additive.

When synthetic yarn is coated with 3% of this lubricant and tested in accordance with the procedure of EXAMPLE I, very little or no lubricant throw-off or misting will be observed and the friction observed in this test will be no greater than that observed in the test of EXAMPLE I.

While the invention has been described in detail with reference to specific embodiments, it is understood that various modifications and changes can be made without departing from the spirit and scope of the invention.

What is claimed is:

1. A methood of improving the adhesive and cohesive properties of a textile lubricating composition comprised of a base oil selected from the group consisting of mineral oil, fatty esters and natural oils and an emulsifing agent comprising incorporating into the lubricant formulation about 0.01 to 10%, based on the total weight of lubricating composition, of a polymer selected from (a) homopolymers of normal alpha-monoolefins having 6 to 14 carbon atoms and (b) copolymers of two or more normal alpha-monoolefins having 4 to 20 carbon atoms, said polymer having a weight average molecular weight of about 1 to 10 million.

2. The method of claim 1 wherein said polymer is a copolymer of butene-1 and at least one alpha-monoolefin having 5 to 14 carbon atoms.

3. The method of claim 2 wherein said polymer is incorporated into the lubricant formulation at a concentration of about 0.05 to 5%, based on the total weight of lubricant formulation.

4. The method of claim 2 wherein the copolymer is selected from the group consisting of butene-1-hexene-1 copolymer, butene-1-octene-1 copolymer, butene-1-decene-1 copolymer, butene-1-dodecene-1 copolymer, butene-1-tetradecene-1 copolymer and mixtures of these.

5. The method of claim 1 or 4 wherein said polymer is incorporated into the lubricant formulation at a concentration of about 0.05 to about 5%, based on the total weight of lubricant formulation.

6. The method of claim 4 wherein said copolymer is incorporated into the lubricant formulation at a concentration of about 0.1 to 2%, based on the total weight of lubricant formulation.

7. A textile lubricant having improved adhesive and cohesive strengths comprised of 50 to 95 weight percent mineral oil, about 5 to 15 weight percent emulsifier and about 0.01 to 10 weight percent of a polymer selected from (a) homopolymers of normal alpha-monoolefins having 6 to 14 carbon atoms and (b) copolymers of at least two normal alpha-monoolefins having 4 to 20 carbon atoms, said polymer having a weight average molecular weight of about 1 to about 20 million and said percentages being based on the total weight of textile lubricant.

8. The composition of claims 7 wherein said copolymer is present in the lubricant formulation at a concentration of about 0.05 to about 5%, based on the total weight of lubricant formulation.

9. The composition of claims 7 wherein said polymer is a copolymer of butene-1 and at least on alpha-monoolefin having 5 to 14 carbon atoms.

10. The composition of claim 9 wherein said polymer is present in the lubricant formulation at a concentration of about 0.05 to 5% based on the total weight of lubricant formulation.

11. The composition of claim 9 wherein the copolymer is selected from the group consisting of butene-1-hexene-1 copolymer, butene-1-octene-1 copolymer, butene-1-decene-1 copolymer, butene-1-dodecene-1 copolymer, butene-1-tetradecene-1 copolymer and mixtures of these.

12. The composition of claim 11 wherein said copolymer is present in the lubricant formulation at a concentration of about 0.1 to 2%, based on the total weight of lubricant formulation.

13. In a method of processing yarn wherein a textile lubricant is applied to the yarn to facilitate processing of the yarn, the improvement comprising processing the yarn with about 0.1 to 10%, based on the weight of yarn of a lubricant comprised of about 50 to 95 weight percent mineral oil, about 2 to 50 weight percent emulsifier and 0.01 to 10 weight percent of a polymer selected from (a) homopolymers of normal alpha-monoolefins having 6 to 14 carbon atoms and copolymers of at least two normal alpha-monoolefins having 4 to 20 carbon atoms, said polymer having a weight average molecular weight of about 1 to about 20 million.

14. The improved method of claim 13 wherein the lubricant is applied to the yarn at a concentration of about 0.05 to 6%, based on the weight of yarn, the polymer is present in the lubricant at a concentration of about 0.05 to 5% based on the total weight of lubricant and the polymer is a copolymer of at least two normal alpha-monoolefins having 4 to 14 carbon atoms.

15. The improved method of claim 13 or 14 wherein said polymer is a copolymer of butene and at least one alpha-monoolefin having 5 to 14 carbon atoms.

16. The improved method of claim 15 wherein said copolymer is selected from the group consisting of butene-1-hexene-1 copolymer, butene-1-octene-1 copolymer, butene-1-decene-1 copolymer, butene-1-dodecene-1 copolymer, butene-1-tetradecene-1 copolymer and mixtures of these.

* * * * *